US006597321B2

(12) United States Patent
Thursby et al.

(10) Patent No.: US 6,597,321 B2
(45) Date of Patent: Jul. 22, 2003

(54) ADAPTIVE VARIABLE IMPEDANCE TRANSMISSION LINE LOADED ANTENNA

(75) Inventors: Michael H. Thursby, Palm Bay, FL (US); Kerry L. Greer, Palm Bay, FL (US)

(73) Assignee: SkyCross, Inc., Melbourne, FL (US)

( * ) Notice: Subject to any disclaimer, the term of this patent is extended or adjusted under 35 U.S.C. 154(b) by 0 days.

(21) Appl. No.: 10/007,818

(22) Filed: Nov. 8, 2001

(65) Prior Publication Data

US 2003/0085843 A1 May 8, 2003

(51) Int. Cl.[7] ..... H01Q 11/12
(52) U.S. Cl. ..... 343/744; 343/745
(58) Field of Search ..... 343/744, 745, 343/741, 731, 700 MS, 749, 829, 846

(56) References Cited

U.S. PATENT DOCUMENTS

| | | | |
|---|---|---|---|
| 2,688,083 | A | 8/1954 | Hills |
| 3,742,393 | A | 6/1973 | Karp |
| 3,925,738 | A | 12/1975 | Bates et al. |
| 4,435,689 | A | 3/1984 | McDowell |
| 4,465,988 | A | 8/1984 | Moats |

(List continued on next page.)

FOREIGN PATENT DOCUMENTS

EP 0 691 738 A1 1/1996

EP 1 026 774 A2 8/2000

OTHER PUBLICATIONS

Harvey, A. F.; "Periodic and Guiding Structures at Microwave Frequencies"; IRE Transactions on Microwave Theory and Techniques; Jan., 1960; pp. 30–61.

Harrington, Roger F.; "Effect of Antenna Size on Gain, Bandwidth, and Efficiency"; Journal of Research of the National Bureau of Standards—D. Radio Propagation; vol. 64D, No. 1, Jan.–Feb. 1960.

Apostolos; "Multi–Layer, Wideband Meander Line Loaded Antenna"; U.S. patent application Publication; Pub. No. US 2001/0048394 A1; Pub. Date Dec. 6, 2001.

*Primary Examiner*—Hoang Nguyen
(74) *Attorney, Agent, or Firm*—John L. DeAngelis, Jr.; Beusse Brownlee Bowdoin & Wolter, P.A.

(57) ABSTRACT

There is disclosed a meanderline-loaded antenna comprising a ground plane, a non-driven element affixed substantially perpendicular to the ground plane, a driven element affixed substantially perpendicular to the ground plane and a horizontal conductor or radiating element electrically connected between the driven and the non-driven elements and disposed substantially parallel to the ground plane. The non-driven and the driven elements comprise meanderline-loaded couplers that are electrically connected between to the radiating element. A mechanically deformable material is disposed between the radiating element and the ground plane such that in response to an externally generated voltage the mechanically deformable material alters the distance between the ground plane and the radiating element to allow the antenna to adapt to changes in its environment.

22 Claims, 7 Drawing Sheets

U.S. PATENT DOCUMENTS 4,495,503 A 1/1985 Morman
4,692,727 A 9/1987 Wakino et al.
4,764,771 A 8/1988 Sterns
4,847,625 A 7/1989 Dietrich et al.
5,061,944 A 10/1991 Powers et al.
5,313,216 A 5/1994 Wang et al.
5,406,233 A 4/1995 Shih et al.
5,497,164 A 3/1996 Croq
5,504,466 A 4/1996 Chan-Son-Lint et al.
5,680,144 A 10/1997 Sanad
5,790,080 A 8/1998 Apostolos
5,874,919 A 2/1999 Rawnick et al.
5,926,150 A 7/1999 McLean et al.
6,005,525 A 12/1999 Kivela
6,016,122 A 1/2000 Malone et al.
6,025,811 A 2/2000 Canora et al.
6,094,170 A 7/2000 Peng
6,137,453 A 10/2000 Wang et al.
6,166,694 A 12/2000 Ying
6,215,229 B1 4/2001 Kuroda et al.
6,313,716 B1 11/2001 Apostolos
6,323,814 B1 * 11/2001 Apostolos ..... 343/744
6,359,599 B2 * 3/2002 Apostolos ..... 343/895
6,429,820 B1 * 8/2002 Thursby et al. ..... 343/744
6,469,675 B1 * 10/2002 Jo et al. ..... 343/744
6,489,925 B2 * 12/2002 Thursby et al. ..... 343/700 MS

* cited by examiner

ADAPTIVE VARIABLE IMPEDANCE TRANSMISSION LINE LOADED ANTENNA

BACKGROUND OF THE INVENTION

The present invention relates generally to antennae loaded by one or more meanderlines (also referred to as variable impedance transmission lines or slow wave transmission lines), and specifically to a meanderline smart antenna providing adaptive operation in response to environmental stimuli.

It is generally known that antenna performance is dependent upon the size, shape and material composition of the constituent antenna elements and the relationship between certain antenna physical parameters (e.g., length for a linear antenna and diameter for a loop antenna) and the wavelength of the signal received or transmitted by the antenna. These relationships determine several antenna parameters, including input impedance, gain, directivity and the radiation pattern. Generally for an operable antenna, the minimum physical antenna dimension must be on the order of a quarter wavelength of the operating frequency, which thereby advantageously limits the energy dissipated in resistive losses and maximizes the energy transmitted. Quarter wave length and half wave length antennae are the most commonly used.

The burgeoning growth of wireless communications devices and systems has created a significant need for physically smaller, less obtrusive, and more efficient antennae that are capable of operation in multiple frequency bands and/or in multiple modes (i.e., different radiation patterns). Smaller packages do not provide sufficient space for the conventional quarter and half wave length antenna elements. As is known to those skilled in the art, there is also an inverse relationship between physical antenna size and antenna gain, at least with respect to a single-element antenna. Increased gain requires a physically larger antenna, while users continue to demand physically smaller antennae. As a further constraint, to simplify the system design and strive for minimum cost, equipment designers and system operators prefer to utilize antennae capable of efficient multi-frequency and/or wide bandwidth operation. Finally, it is known that the relationship between the antenna frequency and the effective antenna length (in wavelengths) determines the antenna gain. That is, the antenna gain is constant for all quarter wavelength antennae of a specific geometry i.e., at that operating frequency where the effective antenna length is a quarter of a wavelength.

One basic antenna model commonly used in many applications today is the half-wavelength dipole antenna. The radiation pattern is the familiar donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical gain is about 2.15 dBi. A derivative of the half-wavelength dipole is the quarter-wavelength monopole antenna located above a ground plane. The physical antenna length is a quarter-wavelength, but with the ground plane the antenna performance resembles a half-wavelength dipole. Thus, the radiation pattern for a monopole antenna above a ground plane is similar to the half-wavelength dipole pattern, with a typical gain of approximately 2 dBi.

The common free space (i.e., not above ground plane) loop antenna (with a diameter of approximately one-third the wavelength) also displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics. Another conventional antenna is the patch, which provides directional hemispherical coverage with a gain of approximately 3 dBi. Although small compared to a quarter or half wave length antenna, the patch antenna has a relatively low radiation efficiency.

Given the advantageous performance of quarter and half wavelength antennae, conventional antennae are typically constructed with elemental lengths on the order of a quarter wavelength of the radiating frequency. These dimensions allow the antenna to be easily excited and operated at or near a resonance, limiting the energy dissipated in resistive losses and maximizing the transmitted energy. But, as the resonant frequency decreases, the operative wavelength increases and the antenna element dimensions proportionally increase. The meanderline-loaded antenna (MLA) was developed to de-couple the conventional relationship between the antenna length and resonant frequency.

A typical meanderline-loaded antenna is disclosed in U.S. Pat. No. 5,790,080. A meanderline-loaded antenna is also known as a variable impedance transmission line (VITL) antenna. The antenna consists of two vertical conductive elements, a horizontal conductive element and a ground plane, with a gap separating each vertical conductive from the horizontal conductive element.

The antenna further comprises one or more meanderline variable impedance transmission lines bridging each gap. Each meanderline coupler is a slow wave transmission line structure carrying a traveling wave at a velocity less than the free space velocity. Thus the effective electrical length of the slow wave structure is considerably greater than it's actual physical length. Consequently, smaller antenna elements can be employed to form an antenna having, for example, quarter-wavelength properties. Further, in one embodiment the slow wave structure includes separate switchable segments that can be inserted in and removed from the circuit with negligible losses. This switching action changes the effective electrical length of the meanderline coupler and thus changes the effective length of the antenna. Losses are minimized in the switching process because the meanderline is constructed with the active switching structure in the high impedance sections of the meanderline. Thus the current through the switching device is low, resulting in very low dissipation losses and a high antenna efficiency. Although the meanderline antenna offers desirable attributes with a smaller physical volume, as hand-held wireless communications devices continue to shrink, manufacturers continue to demand smaller antennae.

The meanderline-loaded antenna allows the physical antenna dimensions to be significantly reduced, while maintaining an effective electrical length that is a quarter wavelength multiple. The meanderline-loaded antennae operate in the region where the performance is limited by the Chu-Harrington relation, that is, $$\text{efficiency}=FV^2Q,$$

where:

Q=quality factor

V=volume of the structure in cubic wavelengths

F=geometric form factor (F=64 for a cube or a sphere)

Meanderline-loaded antennae achieve this efficiency limit of the Chu-Harrington relation while allowing the effective antenna length to be less than a quarter wavelength at the resonant frequency. Dimension reductions of 10 to 1 can be achieved over a quarter wavelength monopole antenna, while achieving a comparable gain.

All antennae, including the relatively physically small meanderline-loaded antenna, whether enclosed within or protruding from today's popular handheld personal communications devices exhibit the so-called "hand" or "body" effect. Although the antenna is designed and constructed to provide certain ideal performance characteristics, in fact, these characteristics are influenced, some significantly, by the proximity of near-field objects, such as a user's hand, to the antenna while the communications device is in use. This effect is caused when the hand of a person or other grounded object, is placed close to the antenna, forming stray capacitances between the grounded object and the antenna. This effect can significantly detune the antenna, shifting the antenna resonant frequency either up or down, that is off-center with respect to the desired band of operation. The result is a reduction in the received or transmitted signal strength. Also, the hand effect can change the antenna radiation pattern in both the receive and transmit modes of operation. It is difficult to design an antenna that does not suffer the hand-effect problem, and furthermore, since each user handles and holds his or her personal communications device in a different orientation, there is no design strategy that can be universally employed to reduce or eliminate the hand effect.

BRIEF SUMMARY OF THE INVENTION

The antenna constructed according to the teachings of the present invention is designed to overcome the hand effect by adaptively changing certain antenna dimensions in response to a change in one or more antenna performance parameters, thus reducing the hand effect and also any other performance effect that manifests itself by changing the measured antenna performance parameter.

The present invention is an antenna comprising a ground plane, one or more conductive elements, including a horizontal element and at least two spaced-apart vertical elements, each connected to the horizontal element by a meanderline coupler. The meanderline coupler has an effective length, as determined by its physical structure, that influences the total effective electrical length, operating characteristics and pattern shape of the antenna. The use of multiple vertical elements, each with its own meanderline coupler or the use of multiple meanderline couplers on a single vertical element provides controllable operation in multiple frequency bands. An antenna comprising meanderline couplers has a smaller physical size, yet exhibits comparable or enhanced performance over a conventional dipole antenna. Further, the operational bandwidth is greater than typically available from a patch antenna.

In one embodiment, a meanderline coupler antenna operates in two frequency bands, with a unique antenna pattern for each band (i.e., in one band the antenna has a an omnidirectional donut radiation pattern (referred to herein as the monopole mode) and in the other band the majority of the radiation is emitted in a hemispherical pattern (referred to as the loop mode). Advantageously, the meanderline-loaded antenna incorporates a piezoelectric material having changeable dimensional characteristics that in turn change certain antenna physical dimensions to improve antenna performance, especially to overcome the hand effect. A voltage generated in response to one more measured antenna parameters is applied to the piezoelectric devise for moving one or more of the antenna elements and thereby changing, i.e., improving, the measured performance parameter. When operative with a radio or receiver unit, this embodiment thus implements a dynamic radio/antenna feedback control loop that adaptively changes the antenna parameters in response to real time changes in the hand-effect.

BRIEF DESCRIPTION OF THE DRAWINGS

The present invention can be more easily understood in the further advantages and used there are more readily apparent, when considered in view of the description of the preferred embodiments and the following figures in which.

DETAILED DESCRIPTION OF THE INVENTION

Figure 1:
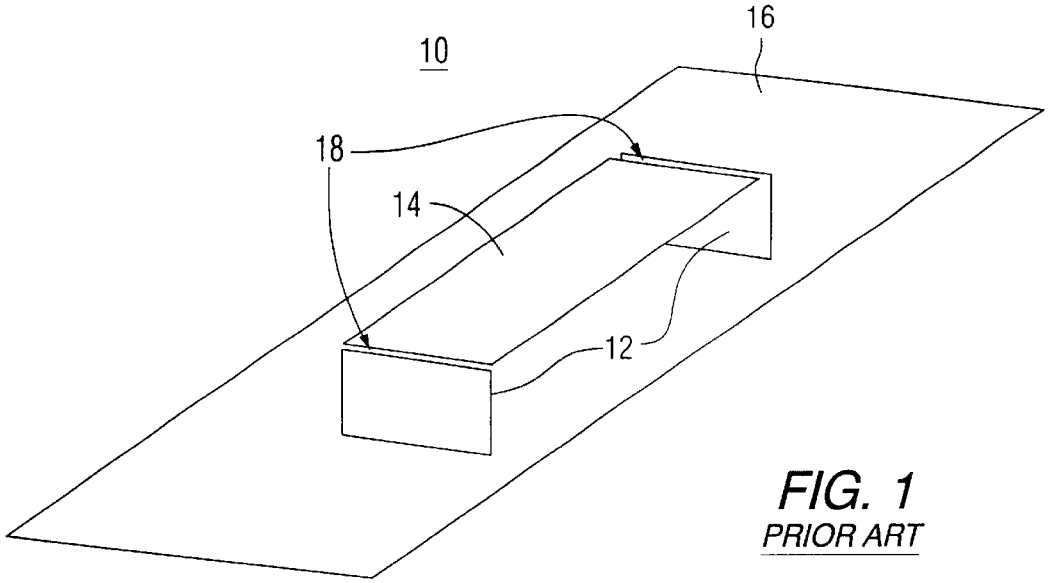
FIG. 1 PRIOR ART
FIG. 1 is a perspective view of the meanderline-loaded antenna of the prior art.

Before describing in detail the particular adaptive multiband meanderline-loaded antenna constructed according to the teachings of the present invention, it should be observed that the present invention resides primarily in a novel and non-obvious combination of apparatus related to meanderline-loaded antennae and antenna technology in general. Accordingly, the hardware components described herein have been represented by conventional elements in the drawings and in the specification description, showing only those specific details that are pertinent to the present invention, so as not to obscure the disclosure with structural details that will be readily apparent to those skilled in the art having the benefit of the description herein.

Figure 2:
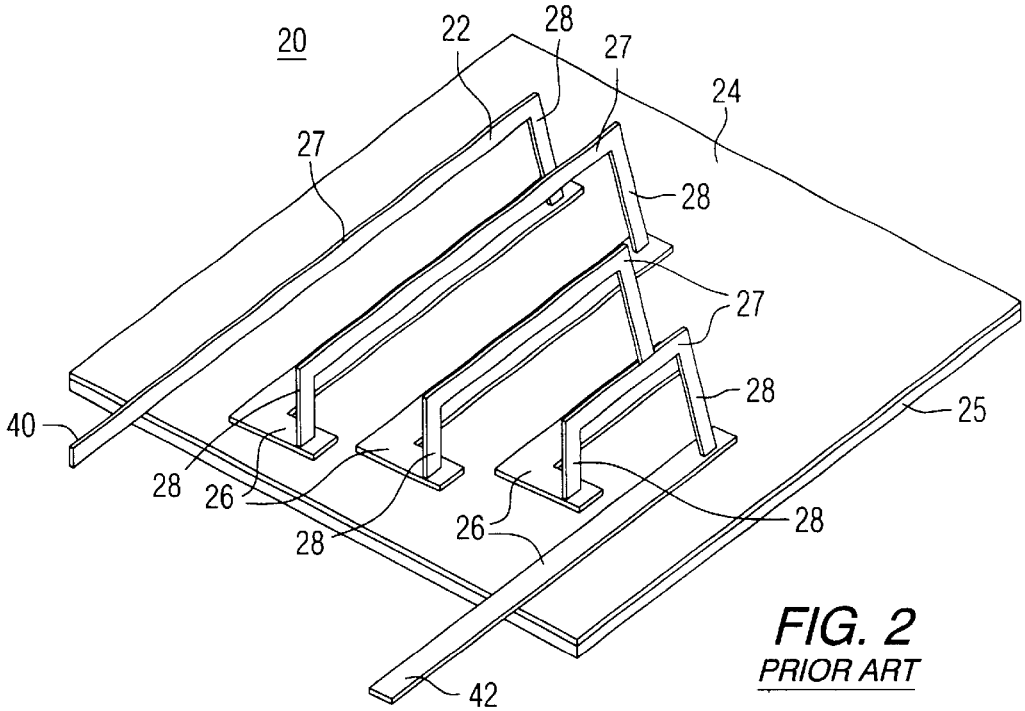
FIG. 2 PRIOR ART
FIG. 2 is a perspective view of a prior art meanderline conductor used as an element coupler in the meanderline-loaded antenna FIG. 1.

FIGS. 1 and 2 depict a prior art meanderline-loaded antenna to which the teachings of the present invention can be advantageously applied to provide adaptive operation in multiple frequency bands and in multiple simultaneous modes.

A schematic representation of a meanderline-loaded antenna 10, also known as a variable impedance transmission line antenna, is shown in a perspective view in FIG. 1. Generally speaking, the meanderline-loaded antenna 10 includes two vertical conductors 12, a horizontal conductor 14, and a ground plane 16. The vertical conductors 12 are physically separated from the horizontal conductor 14 by gaps 18, but are electrically connected to the horizontal conductor 14 by two meanderline couplers, (not shown) one for each of the two gaps 18, to thereby form an antenna structure capable of radiating and receiving RF (radio frequency) energy. The meanderline couplers electrically bridge the gaps 18 and, in one embodiment, have controllably adjustable lengths for changing the characteristics of the meanderline-loaded antenna 10. In one embodiment of the meanderline coupler, segments of the meanderline can be switched in or out of the circuit quickly and with negligible loss, to change the effective length of the meanderline couplers, thereby changing the effective antenna length and thus the antenna performance characteristics. The switching devices are located in high impedance sections of the meanderline couplers, minimizing the current through the switching devices, resulting in low dissipation losses in the switching device and maintaining high antenna efficiency.

The operational parameters of the meanderline-loaded antenna 10 are affected by the input signal wavelength (i.e., the signal to be transmitted by the antenna) relative to the antenna effective electrical length (i.e., the sum of the meanderline coupler lengths plus the antenna element lengths). According to the antenna reciprocity theorem, the antenna operational parameters are also substantially affected by the received signal frequency. Two of the various modes in which the antenna can operate are discussed herein below.

Although illustrated in FIG. 1 as having generally rectangular plates, it is known to those skilled in the art that the vertical conductors 12 and the horizontal conductor 14 can be constructed from a variety of conductive materials and shapes. For instance, thin metallic conductors having a length significantly greater than their width could serve as the vertical conductors 12 and the horizontal conductor 14. Or, single or multiple lengths of heavy gauge wire or conductive material in a filamental shape could be used.

FIG. 2 shows a perspective view of a meanderline coupler 20 constructed for use in conjunction with the meanderline-loaded antenna 10 of FIG. 1. Two meanderline couplers 20 are generally required for use with the meanderline-loaded antenna 10; one meanderline coupler 20 bridging each of the gaps 18 illustrated in FIG. 1. However, it is not necessary for the two meanderline couplers to have the same physical (or electrical) length. The meanderline coupler 20 of FIG. 2 is a slow wave meanderline element (or variable impedance transmission line) in the form of a folded transmission line 22 mounted on a dielectric substrate 24, which is in turn mounted on a plate 25. In one embodiment, the transmission line 22 is constructed from microstrip line. Sections 26 are mounted close to the dielectric substrate 24; sections 27 are spaced apart from the dielectric substrate 24. In one embodiment as shown, sections 28, connecting the sections 26 and 27, are mounted orthogonal to the substrate 24. The variation in height of the alternating sections 26 and 27 from the substrate 24 gives the sections 26 and 27 different impedance values with respect to the substrate 24. As shown in FIG. 2, each of the sections 27 is approximately the same distance above the dielectric substrate 24. However, those skilled in the art will recognize that this is not a requirement for the meanderline coupler 20. Instead, the various sections 27 can be located at differing distances above the dielectric substrate 24. Such modifications change the electrical characteristics of the coupler 20 from the embodiment employing uniform distances. As a result, the characteristics of the antenna employing the coupler 20 are also changed. The impedance presented by the meanderline coupler 20 can be controlled by changing the material or thickness of the microstrip substrate or by changing the width of the sections 26, 27 or 28. In any case, the meanderline coupler 20 must present a controlled (but controllably variable if the embodiment so requires) impedance.

The sections 26 are relatively close to the dielectric substrate 24 (and thus the plate 25) to create a lower characteristic impedance. The sections 27 are a controlled distance from the substrate 24, wherein the distance determines the characteristic impedance and frequency characteristics of the section 27 in conjunction with the other physical characteristics of the folded transmission line 22.

The meanderline coupler 20 illustrated in FIG. 2 is constructed using microstrip technology. Those skilled in the art recognize that stripline technology can also be utilized to construct slow wave meanderline couplers. As expected, the length and shape of the conductors in the stripline embodiment would be dissimilar to those shown in FIG. 2, recognizing the different physical principles governing the characteristics of stripline and microstrip.

Figure 3A:
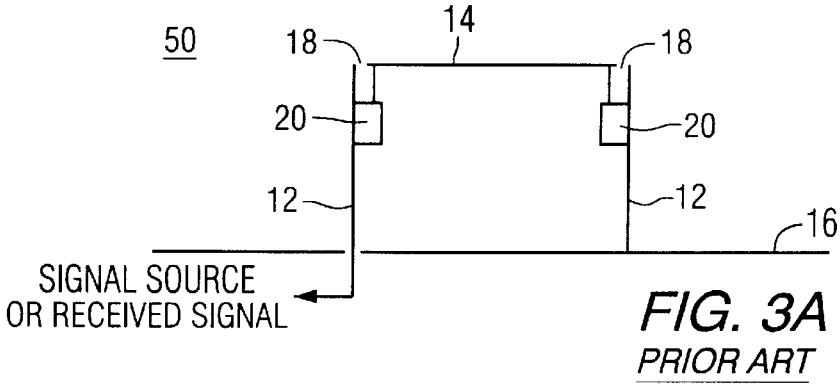
FIG. 3A PRIOR ART
FIGS. 3*a* and 3*b* illustrate two embodiments for placement of the meanderline couplers relative to the antenna element.

The meanderline coupler 20 includes terminating points 40 and 42 for connection to the elements of the meanderline-loaded antenna 10. Specifically, FIG. 3A illustrates two meanderline couplers 20, one affixed to each of the vertical conductors 12 such that the vertical conductor 12 serves as the plate 25 from FIG. 2, forming a meanderline-loaded antenna 50. One of the terminating points shown in FIG. 2, for instance the terminating point 40, is connected to the horizontal conductor 14 and the terminating point 42 is connected to the vertical conductor 12. The second of the two meanderline couplers 20 illustrated in FIG. 3A is configured in a similar manner.

Figure 3B:
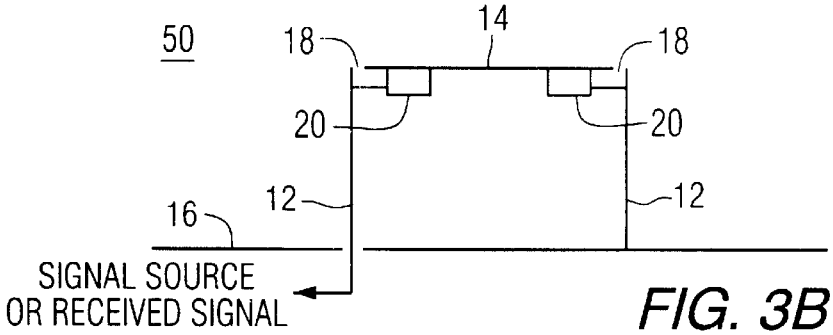
FIG. 3B PRIOR ART

FIG. 3B shows the meanderline couplers 20 affixed to the horizontal conductor 14, such that the horizontal conductor 14 serves as the plate 25 of FIG. 2. As in FIG. 3A, the terminating points 40 and 42 are connected to the vertical conductors 12 and the horizontal conductor 14, respectively, so as to interconnect the vertical conductors 12 and the horizontal conductor 14 across the gaps 18. In both FIGS. 3A and 3B, one of the vertical conductors, for example the vertical conductor 12, includes the signal source feed point when operative in the transmit mode or the point from which the received signal is taken when operative in the receive mode.

Figure 4:
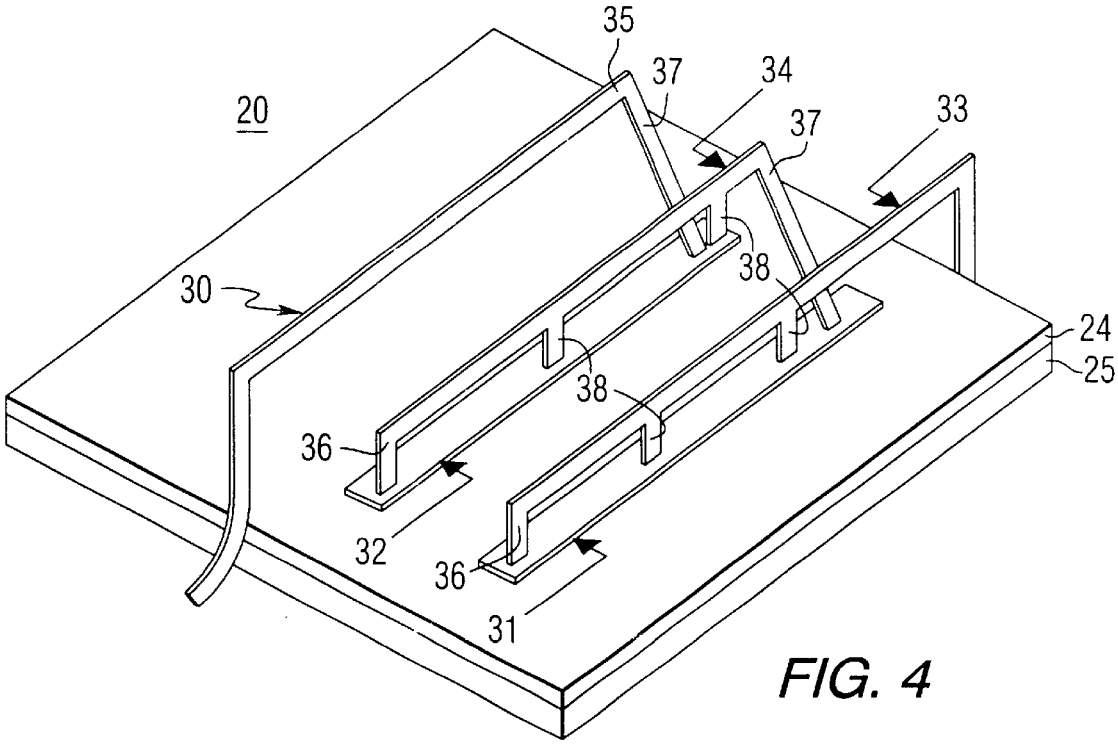
FIG. 4 shows another embodiment of a meanderline coupler.

FIG. 4 is a representational view of a second embodiment of the meanderline coupler 20, including low-impedance sections 31 and 32 and relatively higher-impedance sections 33, 34, and 35. The low impedance sections 31 and 32 are located in a parallel spaced-apart relationship to the higher impedance sections 33 and 34. The sequential low impedance sections 31 and 32 and the higher impedance sections 33, 34, and 35 are connected by substantially orthogonal sections 36 and by diagonal sections 37. The FIG. 4 embodiment includes shorting switches 38 connected between the adjacent lower and higher impedance sections 32/34 and 31/33. The shorting switches 38 provide for electronically switchable control of the meanderline coupler length, by opening or closing the path between the lower impedance sections 31 and 32 and the higher impedance sections 33, 34 and 35. As discussed above, the length of the meanderline coupler 20 has a direct impact on the frequency characteristics of the meanderline-loaded antenna 50 to which the meanderline couplers 20 are attached. As is well known in the art, there are several alternatives for implementing the shorting switches 38, including mechanical or MEMS (microelectromechanical system) switches or electronically controllable switches, such as pin diodes. In the embodiment of FIG. 4, all of the low-impedance sections 31 and 32 and the higher-impedance sections 33, 34, and 35 are of approximately equal length, although this is not necessarily required according to the teachings of the present invention.

The operating mode of the meanderline-loaded antenna 50 (in FIGS. 3A and 3B) depends upon the relationship between the antenna operating frequency and the effective electrical length, including the meanderline couplers 20. Thus the meanderline-loaded antenna 50, like all antennae, has an effective electrical length causing it to exhibit operational characteristics determined by the transmit signal frequency in the transmit mode and the received frequency in the receiving mode. Specifically, the ratio of the signal wavelength to the antenna effective length determines the antenna operational characteristics. Different operating frequencies excite the antenna so that it exhibits different operational characteristics, including different antenna radiation patterns. For example, a long wire antenna may exhibit the characteristics of a quarter wavelength monopole at a first frequency and exhibit the characteristics of a full-wavelength dipole at a frequency of twice the first frequency.

In accordance with the teachings of the present invention, the length of one or more of the meanderline couplers 20 and/or the thickness of the dielectric substrate 24 (which establishes the distance between the dielectric substrate 24 and the folded transmission line 22) can be changed to alter the antenna effective electrical length relative to the signal wavelength, and in this way change the operational mode at the same input signal frequency.

Figure 5:
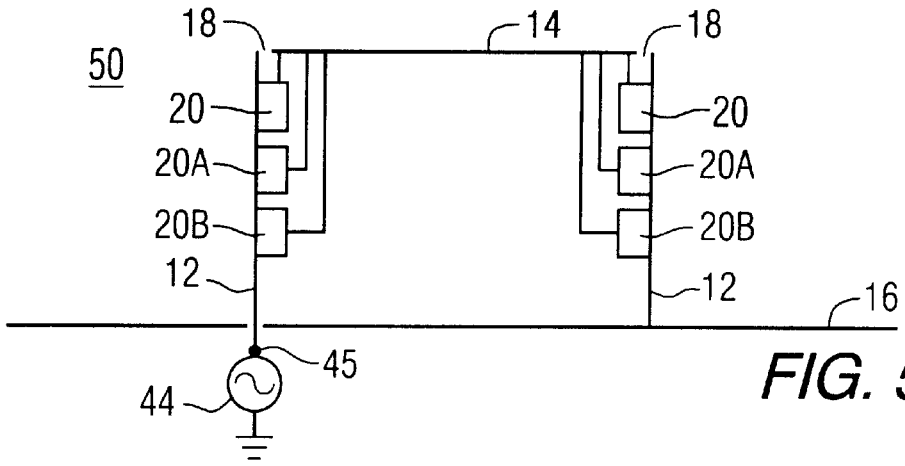
FIG. 5 illustrates the use of a selectable plurality of meanderline couplers with the meanderline-loaded antenna of FIG. 1.

Still further, a plurality of meanderline couplers 20 of different lengths can be connected between the horizontal conductor 14 and the vertical conductors 12. Two matching meanderline couplers 20 on opposing sides of the horizontal conductor 14 are selected to interconnect the horizontal conductor 14 and the vertical conductors 12. Such an embodiment is illustrated in FIG. 5 including matching meanderline couplers 20, 20A and 20B and an input signal source 44. In the receiving mode the signal source 44 is inactive, and the received signal is available at the terminal 45. A controller (not shown in FIG. 5) is connected to the meanderline couplers 20, 20A and 20B for selecting the operative matching meanderline couplers. Well-known switching arrangement can activate the selected meanderline coupler to connect the horizontal conductor 14 and the vertical conductors 12. The vertical conductor 12 is responsive to the input signal in the transmit mode at the terminal 45 (and providing the received signal at the terminal 45 in the receive mode) is also referred to as the driven element or driven conductor. The other vertical conductor 12 is referred to as the non-driven element or non-driven conductor. In another embodiment, both vertical conductors 12 can be driven, with the radiated signal formed as a composite signal depending on the amplitude and phase relationship of the two driving signals.

Figure 6:
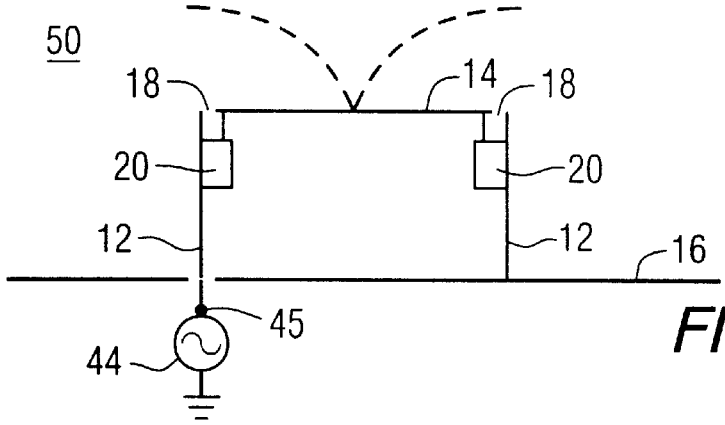
FIGS. 6 through 9 illustrate exemplary operational modes for a meanderline-loaded antenna.
Figure 7:
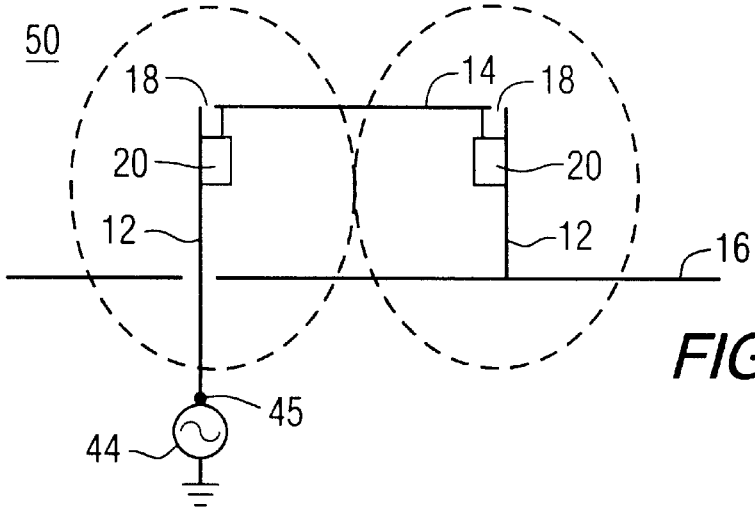

Turning to FIGS. 6 and 7, there is shown the current distribution (FIG. 6) and the antenna electric field radiation pattern (FIG. 7) for the meanderline-loaded antenna 50 operating in a monopole or half wavelength mode as driven by an input signal source 44. That is, in this mode, at a frequency of between approximately 800 and 900 MHz, the effective electrical length of the meanderline couplers 20, the horizontal conductor 14 and the vertical conductors 12 is chosen such that the horizontal conductor 14 has a current null near the center and current maxima at each edge. As a result, a substantial amount of radiation is emitted from the vertical conductors 12, and little radiation is emitted from the horizontal conductor 14. The resulting field pattern has the familiar omnidirectional donut shape as shown in FIG. 7.

Those skilled in the art will realize that a frequency of between 800 and 900 MHz is merely exemplary. The antenna operational characteristics change when excited by signals at other frequencies because the relationship between the antenna component geometries and the signal frequency changes. Further, the dimensions, geometry and material of the antenna components (the meanderline couplers 20, the horizontal conductor 14, the ground plane 16 and the vertical conductors 12) can be modified by the antenna designer to create an antenna having different antenna characteristics at other frequencies or frequency bands.

Figure 8:
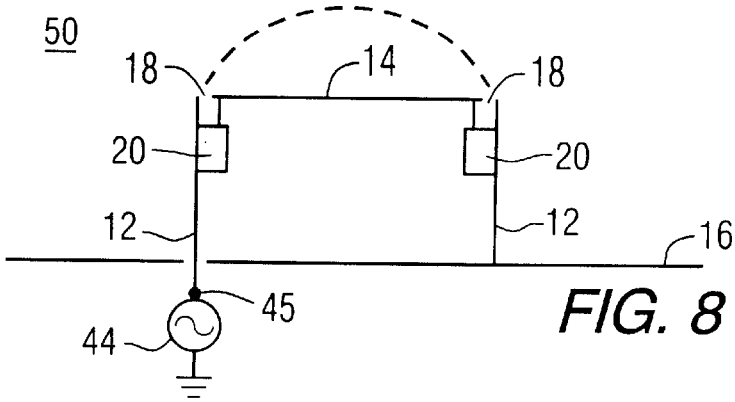
Figure 9:
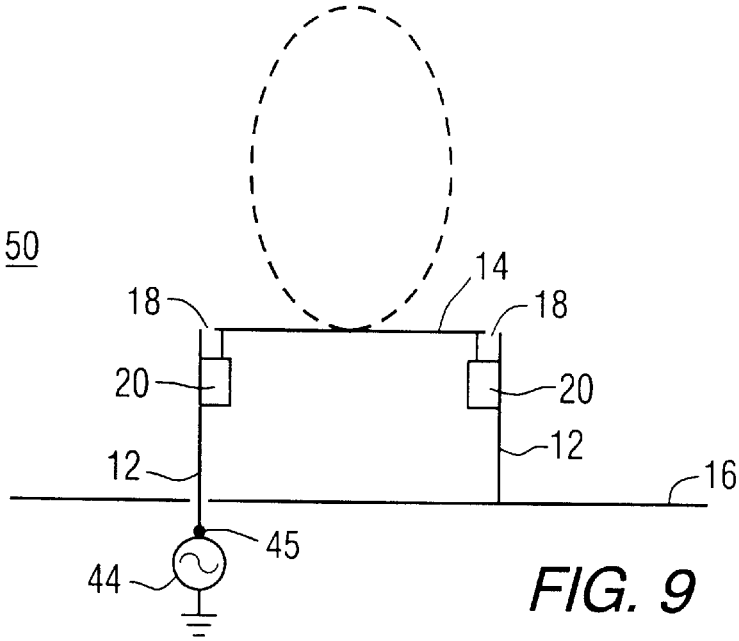

A second exemplary operational mode for the meanderline-loaded antenna 50 is illustrated in FIGS. 8 and 9. This mode is the so-called loop mode, operative when the ground plane 16 is electrically large compared to the effective length of the antenna. In this mode the current maximum occurs approximately at the center of the horizontal conductor 14 (see FIG. 8) resulting in an electric field radiation pattern as illustrated in FIG. 9. The antenna characteristics displayed in FIGS. 8 and 9 are based on an antenna of the same effective electrical length (including the length of the meanderline couplers 20) as the antenna depicted in FIGS. 6 and 7. Thus, at a frequency of approximately 800 to 900 MHz, the antenna displays the characteristics of FIGS. 6 and 7, and for a signal frequency of approximately 1.5 GHz, the same antenna displays the characteristics of FIGS. 8 and 9. By changing the antenna element electrical lengths, monopole and loop characteristics can be attained at other frequency pairs. Generally, the meanderline loaded antenna exhibits monopole-like characteristics at a first frequency and loop-like characteristics at a second frequency where there is a loose relationship between the two frequencies, however, the relationship is not necessarily a harmonic relationship. A meanderline-loaded antenna constructed according to FIG. 1 and as further described hereinbelow, exhibits both monopole and loop mode characteristics, while typically most prior art antennae operate in only a loop mode or in monopole mode. That is, if the antenna is in the form of a loop, then it exhibits a loop pattern only. If the antenna has a monopole geometry, then only a monopole pattern can be produced. In contrast, a meanderline-loaded antenna according to the teachings of the present invention exhibits both monopole and loop characteristics.

Advantageously, the antenna of the present invention can also be operated simultaneously in two different modes dependent on the input signal frequency, that is, in the loop mode and the monopole mode. For example, a meanderline-loaded antenna can be fed from a single input feed point with a composite signal carrying information on two different frequencies. In response, the meanderline-loaded antenna radiates each signal in a different mode, i.e., one signal is radiated in the loop mode and the other signal is radiated in the monopole mode. For instance, a signal at about 800 MHz radiates in the monopole mode and simultaneously a signal at about 1500 MHz radiates in the loop mode, notwithstanding that the length of the top plate is less than a quarter wavelength at both frequencies. In the monopole mode the radiation is directed primarily toward the horizon in an omnidirectional pattern, with a gain of approximately 2.5 dBi within the frequency band of approximately 806 to 960

MHz. In the loop mode the radiation is directed primarily overhead at a gain of approximately 4 dBi, within a frequency band of approximately 1550 to 1600 MHz.

By changing the geometrical features of a meanderline-loaded antenna constructed according to the teachings of the present invention, the antenna can be made operative in other frequency bands, including the FCC-designated ISM (Industrial, Scientific and Medical) band of 2400 to 2497 MHz.

Proper orientation and feeding of two antennae constructed according to the teachings of the present invention can produce a composite signal having elliptical polarization. For example, two antennae oriented at 90 degrees with respect to each other and having equal gain in each dimension, produce a circularly polarized signal, which is useful for satellite communications, when the two input signals are properly related.

Figure 10:
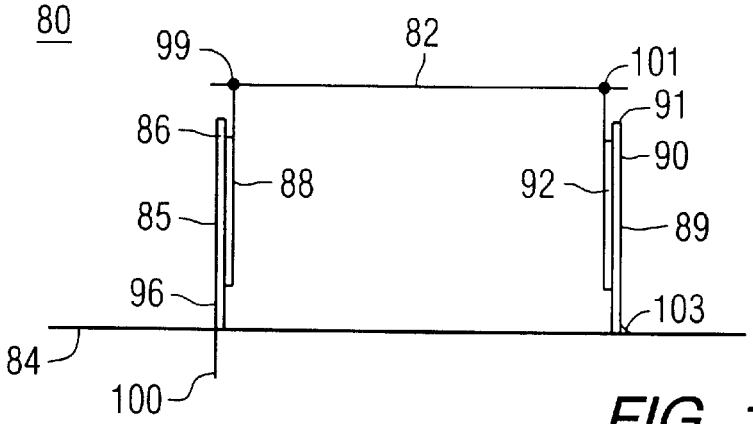
FIGS. 10 through 14 illustrate meanderline-loaded antennae and elements thereof constructed according to the teachings of the present invention.

FIG. 10 illustrates another embodiment of a meanderline-loaded antenna, specifically a meanderline-loaded antenna 80, including a horizontal conductor 82 and a ground plane 84. A meanderline coupler 85 is formed by wrapping a conductive strand 96 around dielectric substrates 86 and 88, wherein the material of the dielectric substrates 86 and 88 comprises duroid. A meanderline coupler 89 is formed by wrapping a conductive strand 91 around dielectric substrates 90 and 92. The dielectric substrates 86, 88, 90 and 92 can be formed of ceramics, resins, Kapton, K-4, etc. In one embodiment air can serve as the dielectric material, i.e., an air core meanderline.

Figure 11:
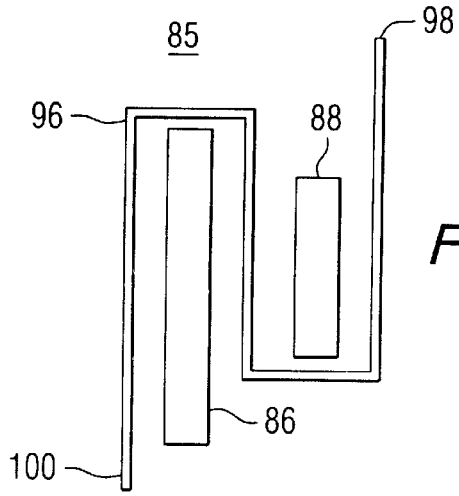

FIG. 11 illustrates the substrates 86 and 88 in a more detailed exploded view, showing the conductive strand 96 passing to one side of the substrate 86, above the substrate 86, between the substrates 86 and 88, below the substrate 88, and finally to the right of substrate 88. The terminal end 98 of the conductive strand 96 is attached to the top plate 82 at a point 99, as illustrated in FIG. 10. The input signal to the meanderline-loaded antenna 88 is provided at a terminal end 100 of the conductive strand 96. Note from FIG. 10 that a segment of the conductive strand 96 passes through an opening in the ground plane 84, thus allowing connection of the terminal end 100 to an input signal. As is known by those skilled in the art, when the meanderline-loaded antenna 80 operates in the receive mode, the received signal is provided at the terminal end 100, from where it is input to the demodulating and recovery circuitry. According to FIG. 10, the conductive strand 91 passing between and around the substrates 90 and 92 is electrically connected to the horizontal conductor 82 at a point 101 and to the ground plane 84, for example, by a connection 103 as shown. Although both of the conductive strands 91 and 96 are shown as forming only a single loop around their respective dielectric substrates, those skilled in the art realize that multiple loops can be formed about the substrates 86, 88, 90 and 92. The conductive strand 98 and the substrates 86 and 88 are joined by any of the well-known adhesives applied to the mating surfaces or by the use of a fastener (not shown) passing through mating holes in the substrates 86 and 88 and the conductive strand 96. The meanderline coupler 89 is formed in a similar fashion.

Figure 12:
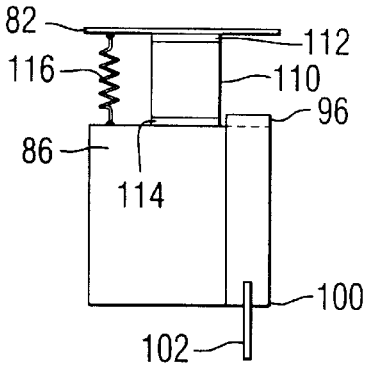

FIG. 12 is a side view of the meanderline-loaded antenna 80 of FIG. 10. In particular, FIG. 12 shows the outside surface of the substrate 86 and a segment of the conductive strand 96. The terminal end 100 is also shown. In this embodiment the conductive strand 96 is formed as a ribbon and a conductor 102 (a coaxial cable, for example) is attached to the terminal end 100 for providing the input signal to the meanderline-loaded antenna 80 when operative in the transmit mode. As shown, in this embodiment the width of the conductive strand is less than the width of the dielectric substrate 86.

As discussed above, the meanderline-loaded antenna 80 is designed to be operable over a desired range of resonant frequencies as determined by the effective antenna length, which is in turn determined by the effective electrical dimensions of the antenna components. It is therefore desirable to change one or more of the antenna dimensions, in response to a change in the external conditions affecting the antenna performance, in an attempt to ameliorate the effects of the external condition. In particular, a so-called "smart" or adaptive antenna is capable of adapting to and thereby reducing the effect of a hand or other grounded object placed proximate the antenna.

Such an adaptive antenna is shown in FIG. 12, where a piezoelectric material 110 is disposed between conductive plates 112 and 114, which are in turn disposed between the horizontal conductor 82 and the meanderline coupler 86 of the meanderline-loaded antenna 80. Also shown is a spring 116 disposed between the horizontal conductor 82 and the meanderline coupler 86. The conductive plates 112 and 114 are responsive to a DC voltage, via conductors (not shown in FIG. 12), wherein the DC voltage is determined by comparing one or more selected received signal characteristics with a reference value for the selected characteristic. In certain applications where the antenna of the present invention is employed in a cellular system, the transmitted signal power of the handset (which is typically commanded by the base station) can also be used. If the measured characteristic differs by more than a predetermined margin from the reference value, a DC voltage of the correct polarity representative of the difference magnitude and sign is applied to the conductive plates 112 and 114, causing the piezoelectric material 110 to expand, overcoming the compressive force of the spring 116 to increase the distance between the top plate 82 and the ground plane 84, thereby attempting to lower the difference between the measured signal characteristic value and the reference value. The spring 116 provides a restorative bias force between the top plate 82 and the meanderline coupler 85 when the voltage is removed. A similar arrangement of a piezoelectric material and a spring can be used in conjunction with the meanderline coupler 89 at the other end of the top plate 82.

The application of the upwardly directed force by the piezoelectric material requires the formation of a movable joint where the meanderline couplers 85 and 89 attach to the ground plane 84. Thus, the terminal end 100 of the meanderline coupler 85 must be movable relative to the ground plane 84. Also, the connection 103 between the meanderline coupler 89 and the ground plane 84 must allow movement of the top plate 82 relative to the ground plane 84. These movable joints can be formed from a loop of a flexible conductor or by a conductive bellows device, both of which retain the necessary continuity as the piezoelectric material expands, but are sufficiently resilient and extensible to allow this movement without breaking the electrical conductive paths. In one embodiment the range of this expansion is several thousandths of an inch.

The dimensional change achievable with piezoelectric material is a function of the material piezoelectric constant and the applied voltage. Although the piezoelectric material 110 illustrated in FIG. 12 is shown as a single bulk material, in fact, layers of piezoelectric material can be used in lieu thereof. Also, the piezoelectric material and the conductive plates 112 and 114 can be formed in any one of many cross-sectional shapes, including a rectangle, circle, square or triangle. The piezoelectric material is selected from a group comprising: lead-titanate ($PbTiO_3$), lead-zirconate ($PbZrO_3$), barium-titanate ($BaTiO_3$), lead-zirconate-titanate ($PbZr_xTi_{1-x}O_3$, where x various from zero to one), quartz and poly vinyladiene difluoride (PVDF). The subscripts x and 1−x represent the molar amounts of lead-zirconate and lead-titanate, respectively. In an alternative embodiment, the piezoelectric material can be an electrically active polymer material. In these embodiments, the dimensional change with bias voltage of an electrically active polymer material can be 100 to 1000 times greater than the change for conventional piezoelectric material.

Figure 13:
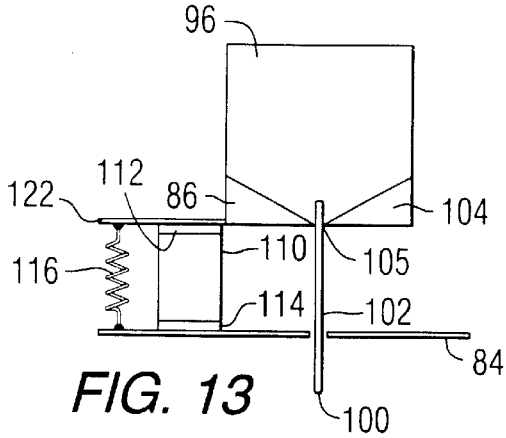

FIG. 13 illustrates another embodiment of an antenna constructed according to the teachings of the present invention, showing the outside surface of the meanderline coupler 85 and the conductive strand 96. In this embodiment, that portion of the conductive strand on the outside surface of the substrate 86 transitions from the ribbon shape to a polygon with a tapered edge 104. The circular conductor 102 is electrically connected to the conductive strand 96 at the taper point 105 for providing the input signal to the meanderline-loaded antenna 80 when operative in the transmit mode or for providing the output signal when operative in the receive mode.

The distance between the top plate 82 and the ground plane 84 is controllable by the piezoelectric material 110 as a function of the voltage applied to the two conductive plates 112 and 114, which are disposed between the ground plane 84 and a plate 122 which is in turn attached to the lower end of the meanderline coupler 85 as shown. The spring 116 is also disposed between the conductive plate 112 and the ground plane 84. The conductive plate 112 can be affixed to the meanderline coupler 85 at any point along either of the vertical edges. As in the FIG. 12 embodiment, the application of a DC or slowly varying AC voltage to the conductive plates 112 and 114 causes mechanical deformation of the piezoelectric material 110, thereby causing the meanderline coupler 85 to move up and down relative to the ground plane 84, in turn changing the distance between the top plate 82 and the ground plane 84. Since the frequency response of the meanderline-loaded antenna 80 is closely related to the antenna volume, the increase in the distance between the top plate 82 and the ground plane 84 changes the antenna resonant or center frequency, bandwidth and the antenna impedance. Thus the antenna characteristics can be adapted to the antenna environment by the application of the piezoelectric voltage and the resultant mechanical deformation caused thereby in the piezoelectric material. Typically, the mechanical deformation is on the order of 1% or 2% of the piezoelectric material dimension along the deformation axis.

Figure 14:
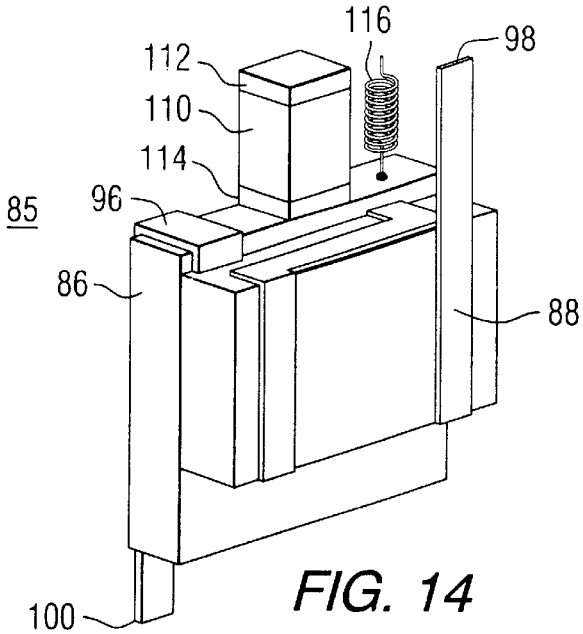

FIG. 14 illustrates another embodiment of the meanderline coupler 85, including the dielectric substrates 86 and 88 and the conductive strand 96. Note that in this embodiment the conductive strand 96 passes between the dielectric substrates 86 and 88. After passing along the bottom surface of the substrate 88, the conductive strand 96 runs vertically along the inside surface of the substrate 88 and then horizontally along the top surface of the substrate 88. The conductive strand 96 then passes between the substrates 86 and 88 to the bottom surface of the substrate 88, after which it passes along the front surface thereof, terminating at the end point 98 for connection to the top plate 82 at a point 99. See FIG. 10. The meanderline coupler 89 is constructed in a similar fashion. Also shown in FIG. 14 is the piezoelectric material 110, and the plates 112 and 114. This assembly is disposed between the top surface of the dielectric substrate 86 and the bottom surface of the top plate 82. Further, the spring 116 provides a biasing force between the top surface of the dielectric substrate 86 and the bottom surface of the top plate 82. The FIG. 14 embodiment of the present invention functions similar to the embodiment described with respect to FIG. 12.

In yet another embodiment, one or both of the dielectric substrates 86 and 88 is replaced by a piezoelectric material (including opposed facing plates for the application of the control voltage) to change the characteristics of the meanderline coupler 85 (and thus the meanderline-loaded antenna) by changing the distance between segments of the conductive strand 96, and/or changing the thickness of the dielectric substrate, in accordance with changes in a measured antenna performance metric. In still another embodiment, the dielectric substrates 86 and 88 are retained, but the piezoelectric material is placed adjacent one of both of the dielectric substrates 86 and 88, or the piezoelectric material is disposed between the two facing surfaces of the dielectric substrates 86 and 88 to change the distance between segments of the conductive strand 96, thereby changing the effective electrical length of the meanderline coupler 85 and the antenna 80.

Figure 15:
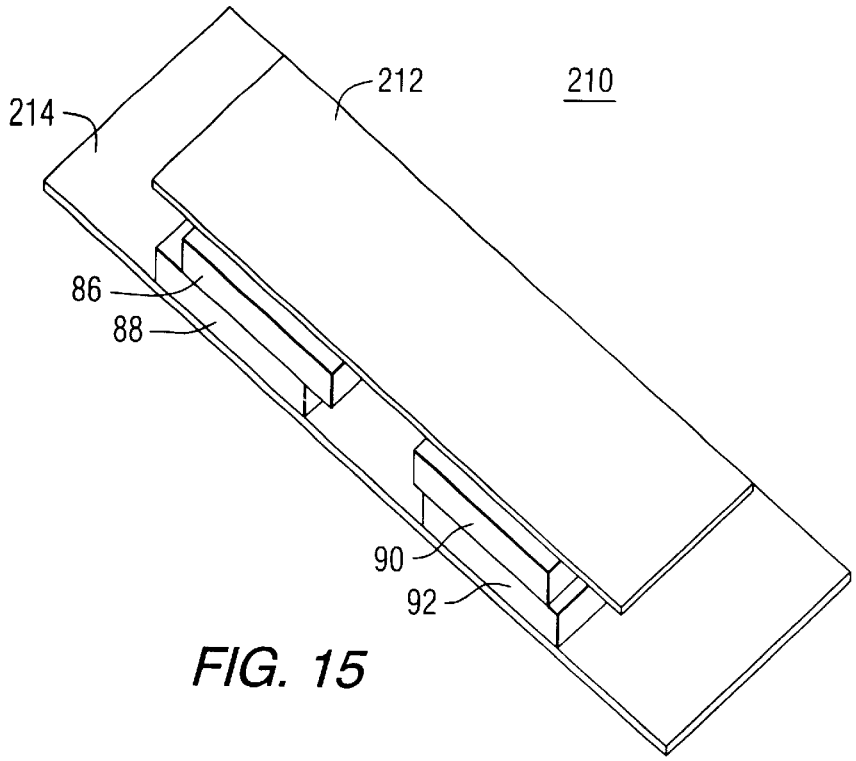
FIGS. 15 and 16 illustrate a low profile embodiment of a meanderline-loaded antenna constructed of according to the teachings of the present invention.

FIG. 15 is a perspective view of yet another embodiment of the present invention, that is, a meanderline-loaded antenna 210 wherein the dielectric substrates 86, 88, 90 and 92 are oriented horizontally below a top plate 212, thus reducing the antenna height. The meanderline-loaded antenna 210 further includes a ground plane 214. The conductive strand 96 shown in FIG. 10 and associated with the dielectric substrates 86 and 88 is connected to a signal source, or a receiver, not shown in FIG. 15. Similarly, the conductive strand 91 associated with the dielectric substrates 90 and 92 is connected to the ground plane 214.

Figure 16:
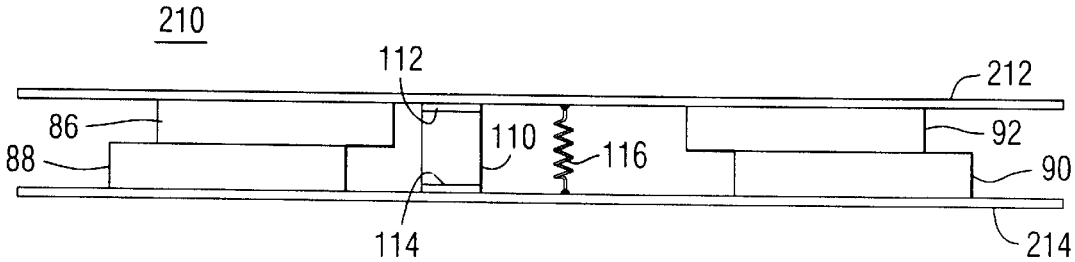

FIG. 16 is a front view of the meanderline-loaded antenna 210, showing the placement of the piezoelectric material 110, the conductive plates 112 and 114 and the spring 116. In this embodiment, mechanical deformation of the piezoelectric material 110 raises the top plate 212 relative to the ground plane 214. The bias action provided by the spring 116 returns the top plate 212 to its normal position wherein no voltage is applied to the conductive plates 112 and 114 and thereby urges the top plate 212 and the ground plane 214 against their respective dielectric substrates 86, 88, 90 and 92. As discussed above, the material forming the electrical connection between the meanderline couplers and the top plate 212 and the ground plane 214 must be sufficiently resilient and extensible to accommodate the dimensional change between the top plate 212 and the ground plane 214.

For the meanderline-loaded antenna 210 of FIG. 16 to exhibit similar antenna performance parameters (especially gain and directivity) to the meanderline-loaded antenna 80 of FIG. 10, it is know by those skilled in the art that the two antennae should have a similar volume. Also, it is known that maximum antenna gain is achieved by maximizing the antenna volume (expressed in cubic wavelengths). The volume of both of the meanderline-loaded antennae 80 and 210 is calculated as the product of the length, width, and height. Since the meanderline-loaded antenna 210 has a smaller height dimension, the width and/or length dimension must be increased and therefore the meanderline couplers 80 must be spaced apart farther than the meanderline couplers 20 of FIG. 10, if similar performance characteristics are to be achieved. The ground plane size, in general also affects the size of the antenna pattern. As a result, the ground plane is customized according to the specific implementation requirements of the meanderline-loaded antenna.

Figure 17:
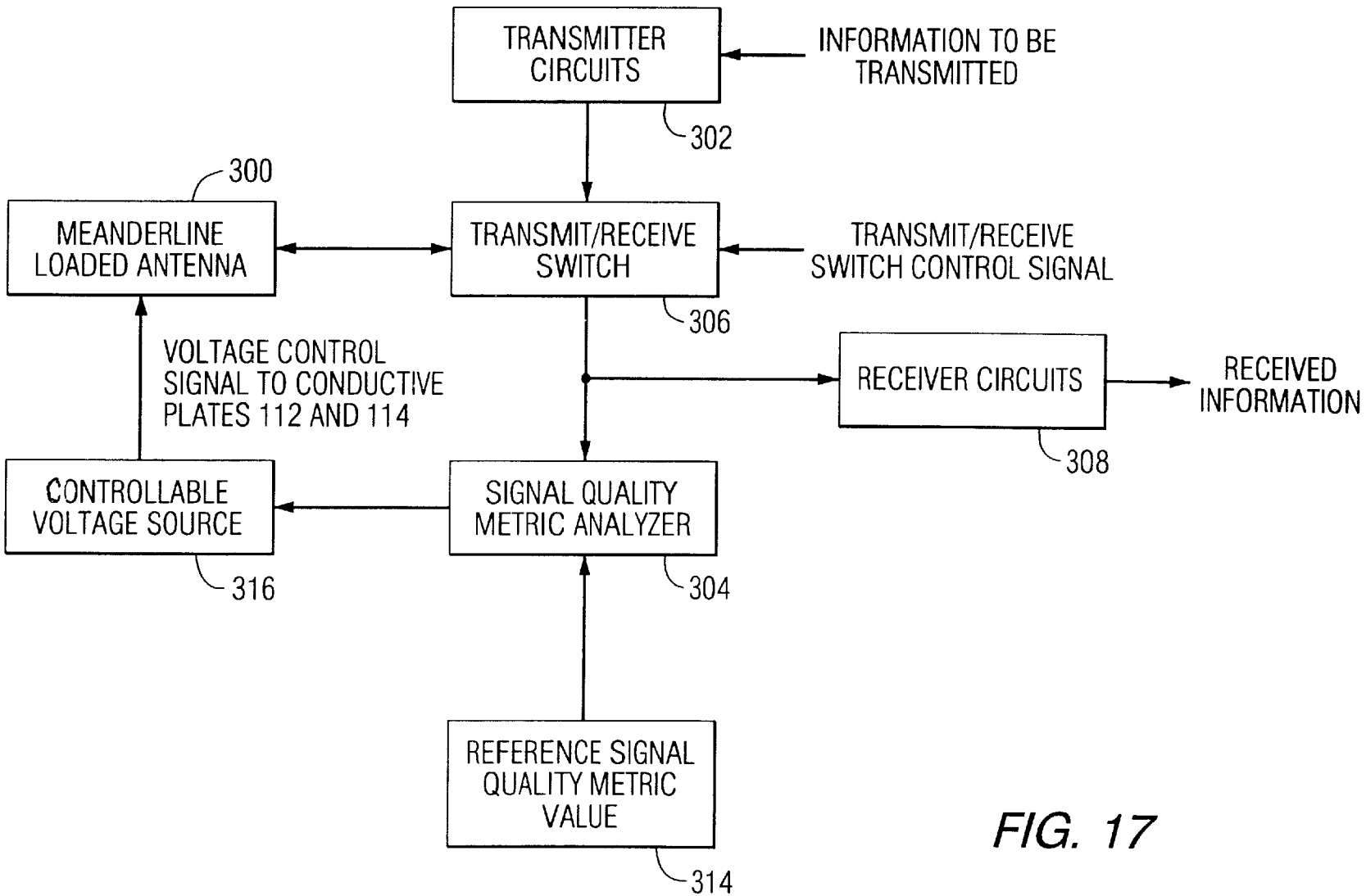
FIG. 17 is block diagram of elements for producing the voltage for controlling the piezoelectric material of the present invention.

FIG. 17 is a block diagram illustrating one technique for generating the voltage provided to the conductive plates 112 and 114 in the meanderline-loaded antenna 300. To determine this voltage, one or more receive signal quality metrics are determined for the received signal. Exemplary signal quality metrics are the signal power-to-interference ratio, the signal-to-noise ratio, the bit error rate, the received center frequency, the correlated received power, the voltage standing-wave ratio and the in-phase and quadrature phase signal amplitudes. As shown, transmitter circuits 302 are isolated from a signal quality metric analyzer 304 by a transmit/receive switch 306. Receiver circuits 308 are connected to the meanderline-loaded antenna 300 via the transmit/receive switch 306, under control of a transmit/receive switch control signal, for demodulating and recovering the received information. The signal quality metric analyzer 304 is also responsive to the received signal as shown. Further, a reference signal quality metric value may be provided from a module 314 to the signal quality metric analyzer 304, if desired, for determining the difference between the reference value and the value associated with the received signal. A error signal representative of that difference is input to a controllable voltage source 316 for producing the appropriate voltage in response thereto for application to the conductive plates 112 and 114. The voltage control signal provides the feedback path back to the meanderline-loaded antenna 300 to close the loop in this adaptive system. In other embodiments the voltage control signal can be derived in the intermediate frequency circuitry or the in-phase/quadrature-phase (I/Q) detector loops of the receiver circuits 308.

Typically, a constant direct current (DC) voltage would be applied to the conductive plates 112 and 114 for controlling the piezoelectric element. However, in another embodiment, a slowly varying AC signal can be applied in lieu thereof to produce a slowly oscillating shift back and forth in the resonant frequency of the meanderline-loaded antenna of the present invention. Although such a shift might generally be undesirable, situations can arise where an interference source causes a slowly-varying oscillation in the received signal frequency. The antenna of the present invention can follow these oscillations and maintain the resonant frequency by application of a slowly varying AC voltage to the piezoelectric material. This process is referred to as dithering in conventional control theory.

Figure 18:
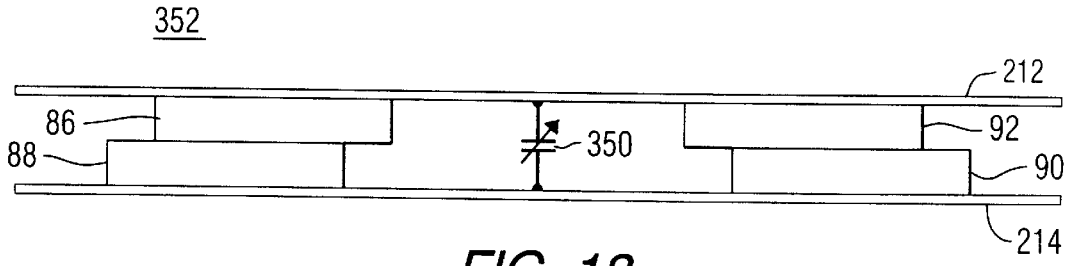
FIG. 18 illustrates an embodiment of a meanderline-loaded antenna constructed according to a varactor embodiment of the present invention.

In another embodiment of the present invention, in lieu of piezoelectric material, a varactor is disposed between two opposing plates of the antenna, such as the top plate 212 and the ground plane 214 of the FIG. 16 embodiment or the horizontal conductor 82 and the ground plane 84 of the FIG. 10 embodiment. The application of a direct current voltage to the varactor, similar to the application of the DC voltage to the piezoelectric material as discussed above, changes the capacitance of the varactor and thus the degree of coupling between the opposing antenna elements, consequently changing the antenna characteristics. The DC voltage is established to achieve a nominal value for a selected antenna performance characteristic, as in the case of the piezoelectric material above. FIG. 18 illustrates a varactor 350 as applied to a meanderline-loaded antenna 352 similar to the meanderline-loaded antenna 210 of FIG. 16.

As is known by those skilled in the art, the various antenna embodiments constructed according to the teachings of the present invention can be used in an antenna array to achieve improved performance characteristics.

While the invention has been described with reference to preferred embodiments, it will be understood by those skilled in the art that various changes may be made and equivalent elements may be substituted for elements thereof without departing from the scope of the present invention. In addition, modifications may be made to adapt a particular situation more material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An antenna having adaptable characteristics in response to a voltage provided by a voltage source, comprising:

a ground plane;

a first meanderline coupler including a first terminal responsive to a signal when said antenna is operative in a transmitting mode and for receiving a signal when said antenna is operative in a receiving mode, and further including a second terminal;

a second meanderline coupler including having a first terminal in electrical connection with said ground plane and further including a second terminal;

a horizontal conductor substantially parallel to and spaced apart from said ground plane and in electrical connection with the second terminal of said first meanderline coupler at a first region of said horizontal conductor, and in electrical-connection with said second terminal of said second meanderline at a second region of said horizontal conductor; and a deformable member located so as to alter the distance between said horizontal conductor and said ground plane in response to the voltage, such that the antenna dimensional change effected by the deformable member alters the antenna radiating characteristics.

2. The antenna of claim 1 wherein the horizontal conductor is formed from a conductive material and is shaped to produce desired antenna characteristics.

3. The antenna of claim 1 wherein the deformable member comprises a piezoelectric material disposed between the ground plane and the horizontal conductor, and wherein the distance between the ground plane and the horizontal conductor is chosen to achieve certain antenna characteristics.

4. The antenna of claim 1 wherein the deformable member comprises a piezoelectric material disposed between parallel-oriented top and bottom conductive plates, wherein application of the voltage to said top and said bottom plates causes mechanical deformation of said piezoelectric material, such that the distance between the ground plane and the horizontal conductor is controlled thereby.

5. The antenna of claim 4 further comprising a compression member disposed parallel to a line perpendicular to the top and the bottom plates, wherein said compression member provides a compression force between the horizontal conductor and the ground plane.

6. The antenna of claim 1 wherein the sum of the effective electrical length of the ground plane plus the effective electrical length of the first and the second meanderline couplers plus the effective electrical length of the horizontal conductor, presents an approximately resonant condition over a desired frequency band.

7. The antenna of claim 1 wherein the first meanderline coupler and the second meanderline coupler each comprise a folded transmission line.

8. The antenna of claim 1 wherein the effective electrical length of the first meanderline coupler and the second meanderline coupler are externally controllable.

9. The antenna of claim 1 wherein the antenna radiation pattern is substantially in the azimuth plane at a first frequency and is substantially in the elevation direction at a second frequency.

10. The antenna of claim 1 wherein the first meanderline coupler and the second meanderline coupler each comprise a dielectric substrate and a transmission line proximate to said dielectric substrate.

11. The antenna of claim 1 wherein each of the first and the second meanderline couplers comprises a dielectric substrate having a conductive trace disposed thereon, and wherein first and second opposing ends of said conductive trace of the first meanderline coupler form, respectively, the first and the second terminals of the first meanderline coupler, and wherein first and second opposing ends of said conductive trace of the second meanderline coupler form, respectively, the first and the second terminals of the second meanderline coupler.

12. The antenna of claim 1 wherein the first meanderline coupler further comprises a first and a second dielectric substrate, and wherein said first dielectric substrate includes first and second opposing surfaces, and wherein said second dielectric substrate includes first and second opposing surfaces, and wherein the first meanderline coupler further includes a conductive trace, wherein the second surface of said first dielectric substrate is disposed proximate the first surface of said second dielectric substrate, and wherein the path of said conductive trace is proximate the second surface of said second dielectric substrate, between the second surface of said first dielectric substrate and the first surface of said second dielectric substrate and proximate the first surface of said first dielectric substrate.

13. The antenna of claim 1 wherein the second meanderline coupler further comprises a first and a second dielectric substrate, and wherein said first dielectric substrate includes first and second opposing surfaces, and wherein said second dielectric substrate includes first and second opposing surfaces, and wherein the second meanderline coupler further includes a conductive trace, wherein the second surface of said first dielectric substrate is disposed proximate the first surface of said second dielectric substrate, and wherein the path of said conductive trace is proximate the second surface of said second dielectric substrate, between the second surface of said first dielectric substrate and the first surface of said second dielectric substrate and proximate the first surface of said first dielectric substrate.

14. The antenna of claim 1 wherein the first and the second meanderline couplers are affixed to one of the ground plane and the horizontal conductor by an extensible joint, such that said extensible joints permit the distance between the ground plane and the horizontal conductor to be altered by the action of the deformable member.

15. An antenna having adaptable characteristics in response to a voltage provided by a voltage source, comprising:

a ground plane;

a first meanderline coupler including a first terminal responsive to a signal when said antenna is operative in a transmitting mode and for receiving a signal when said antenna is operative in a receiving mode, and further including a second terminal;

a second meanderline coupler including a first terminal conductively connected to said ground plane and further including a second terminal;

a horizontal conductor substantially parallel to and spaced apart from said ground plane and in electrical connection with the second terminal of said first meanderline coupler at a first region of said horizontal conductor, and in electrical connection with the second terminal of said second meanderline at a second region of said horizontal conductor;

wherein said first and said second meanderline couplers each have a top surface proximate said horizontal conductor; and a mechanically deformable material disposed between said horizontal conductor and said top surface of said first meanderline coupler, or disposed between said horizontal conductor and said top surface of said second meanderline coupler, or disposed between said horizontal conductor, and said top surface of each of said first and said second meanderline couplers, wherein said mechanically deformable material is responsive to the voltage for changing the dimensions thereof along an axis perpendicular to said horizontal conductor, such that the distance between said ground plane and said horizontal conductor changes in response thereto, such that the antenna dimensional change effected by the deformable member alters the antenna radiating characteristics.

16. The antenna of claim 15 wherein the deformable member comprises a piezoelectric material disposed between parallel-oriented top and bottom conductive plates, and wherein the application of the voltage between said top and bottom conductive plates causes mechanical deformation of said piezoelectric material, and wherein the deformation affects the distance between the ground plane and the horizontal conductor.

17. The antenna of claim 16 further comprising a compression member disposed parallel to align intersecting the top and the bottom plates, wherein said compression member provides a compression force between the horizontal conductor and the ground plane.

18. The antenna of claim 16 wherein the deformable member comprises piezoelectric material disposed between parallel-oriented top and bottom conductive plates, and wherein the application of the voltage between said top and bottom plates causes mechanical deformation of said piezoelectric material.

19. An antenna having adaptable characteristics in response to a voltage provided by a voltage source comprising:

a ground plane;

a first meanderline coupler including a first terminal responsive to a signal when said antenna is operative in a transmitting mode and for receiving a signal when said antenna is operative in a receiving mode, and further including a second terminal;

a second meanderline coupler including a first terminal in electrical connection with said ground plane and further including a second terminal;

a horizontal conductor spaced apart from and substantially parallel to said ground plane and in electrical connection with the second terminal of said first meanderline coupler at a first region of said horizontal conductor, and in electrical connection with the second terminal of said second meanderline coupler at a second region of said horizontal conductor; and a mechanically deformable material disposed between said ground plane and a bottom surface of at least one of said first meanderline coupler and said second meanderline coupler, wherein said mechanically deformable material is responsive to the voltage for changing the dimensions of said mechanically deformable material along an axis perpendicular to said ground plane, such that the distance between said ground plane and said horizontal conductor changes in response thereto, such that the antenna dimensional change effected by the deformable member alters the antenna radiating characteristics.

20. An antenna having adaptable characteristics in response to a voltage provided by a voltage source, comprising:

a ground plane;

a first meanderline coupler including a first terminal responsive to a signal when said antenna is operative in a transmitting mode and for receiving a signal when said antenna is operative in a receiving mode, and further including a second terminal;

a second meanderline coupler including having a first terminal in electrical connection with said ground plane and further including a second terminal;

a horizontal conductor substantially parallel to and spaced apart from said ground plane and in electrical connection with the second terminal of said first meanderline coupler at a first region of said horizontal conductor, and in electrical connection with said second terminal of said second meanderline at a second region of said horizontal conductor; and wherein at least one of said first and said second meanderline couplers comprises a transmission line proximate a dielectric substrate, and wherein said dielectric substrate comprises piezoelectric material deformable in response to a voltage supplied thereto for changing the effective electrical length of at least one of said first and said second meanderline couplers, such that the antenna operational characteristics are changed in response thereto.

21. An antenna having adaptable characteristics in response to a voltage provided by a voltage source, comprising:

a ground plane;

a first meanderline coupler including a first terminal responsive to a signal when said antenna is operative in a transmitting mode and for receiving a signal when said antenna is operative in a receiving mode, and further including a second terminal;

a second meanderline coupler including having a first terminal in electrical connection with said ground plane and further including a second terminal;

a horizontal conductor substantially parallel to and spaced apart from said ground plane and in electrical connection with the second terminal of said first meanderline coupler at a first region of said horizontal conductor, and in electrical connection with said second terminal of said second meanderline at a second region of said horizontal conductor; and wherein at least one of said first and said second meanderline couplers comprises a folded transmission line disposed between a plurality of dielectric substrate layers and further comprising a piezoelectric material disposed between two of said plurality of dielectric substrate layers, wherein said piezoelectric material is responsive to a voltage for altering the effective electrical length of the at least one of said first and said second meanderline couplers.

22. An antenna having adaptable characteristics in response to a voltage provided by a voltage source, comprising:

a ground plane;

a first meanderline coupler including a first terminal responsive to a signal when said antenna is operative in a transmitting mode and for receiving a signal when said antenna is operative in a receiving mode, and further including a second terminal;

a second meanderline coupler including a first terminal in electrical connection with said ground plane and further including a second terminal;

a horizontal conductor substantially parallel to and spaced apart from said ground plane and in electrical connection with the second terminal of said first meanderline coupler at a first region of said horizontal conductor, and in electrical connection with said second terminal of said second meanderline at a second region of said horizontal conductor; and a varactor electrically connected to said ground plane and said horizontal conductor for changing the capacitive coupling between said ground plane and said horizontal conductor.

* * * * *